US005145236A

United States Patent [19]

Liao et al.

[11] Patent Number: 5,145,236

[45] Date of Patent: Sep. 8, 1992

[54] METHOD AND APPARATUS FOR CONTROLLING DUST PRODUCED BY A CONTINUOUS MINER

[75] Inventors: Chung F. Liao, Kingwood, Tex.; George W. Graham, Wilkinson, W. Va.

[73] Assignee: Shell Oil Company, Houston, Tex.

[21] Appl. No.: 695,875

[22] Filed: May 6, 1991

[51] Int. Cl.[5] ..... F21C 35/22

[52] U.S. Cl. ..... 299/12; 261/116; 299/64

[58] Field of Search ..... 299/12, 64; 261/115, 261/116

[56] References Cited

U.S. PATENT DOCUMENTS

| | | | |
|---|---|---|---|
| 2,579,282 | 12/1951 | Vicard | 299/12 X |
| 3,792,568 | 2/1974 | Gundlach et al. | 299/12 X |
| 3,904,246 | 9/1975 | Gandy et al. | 299/81 |
| 4,037,875 | 7/1977 | Justice | 299/31 |
| 4,249,778 | 2/1981 | McGuire | 299/12 X |
| 4,289,509 | 9/1981 | Holter | 299/12 X |
| 4,315,658 | 2/1982 | French et al. | 299/43 |

FOREIGN PATENT DOCUMENTS

| | | | |
|---|---|---|---|
| 3336913 | 4/1985 | Fed. Rep. of Germany | 299/64 |
| 608955 | 5/1978 | U.S.S.R. | 299/12 |
| 1170166 | 7/1985 | U.S.S.R. | 299/12 |

OTHER PUBLICATIONS

"New Water Powered Scrubber", Bureau of Mines, No. 117 Nov. 1981.

"Water-Powered Scrubber for Auger Miner Dust Control", Bureau of Mines, No. 322, Jan. 1989.

"Side-Boom Scrubber for Continuous Miner Dust Control", Bureau of Mines, No. 337, May 1989.

*Primary Examiner*—David J. Bagnell

[57] ABSTRACT

A method and apparatus for controlling the dust produced by continuous underground coal mining machinery. The apparatus comprises a wet scrubber mounted on the pivoted boom adjacent the cutting head and discharges the cleaned air into the air curtain flow. The wet scrubber utilizes twin fluid atomizers to reduce the quantity of water required, produce fine water mist, and permit discharge of the dust-laden air directly to the mine.

5 Claims, 1 Drawing Sheet

METHOD AND APPARATUS FOR CONTROLLING DUST PRODUCED BY A CONTINUOUS MINER

BACKGROUND OF THE INVENTION

The present invention relates continuous mining apparatus, and particularly to a means for controlling the dust produced in a continuous mining operation.

In a continuous mining operation considerable dust is produced as the cutting head of the miner cuts coal away from the cutting face of the mine. Obviously, some means must be provided for proper dust control in the cutting areas of continuous mining apparatus. The dust level present in the air surrounding the continuous mining apparatus must be controlled from both a health standpoint and safety standpoint to prevent explosions.

In U.S. Pat. No. 4,315,658 there is shown continuous mining apparatus that includes a curtain means for guiding the airborne dust generated by the cutting head toward a passage. The passage directs the dust-laden air away from the ventilation air that is supplied to the cutting face of the equipment. Means that includes both fans and hydraulic nozzles are provided for inducing an air flow in the passage means. While the '658 patent shows means for removing the dust-laden air from the vicinity of the cutting head, it does not disclose any means for removing the dust from the air so that the air can be recirculated within the mine. Instead, the '658 patent merely shows discharging the dust-laden air to the rear of the mining apparatus.

In U.S. Pat. No. 3,904,246 there is shown a rotary cutting head for use in a continuous mining apparatus that incorporates air flow inducing devices mounted in the cutting head. In particular, the '246 patent shows air flow guide means in the cutting head with fluid nozzles used for inducing an air flow into the guide means. Again, the '246 patent does not specifically describe any means for removing the dust from the air. The '246 patent does mention the use of nozzles for dispersing a dust suppression fluid in the dust-laden air.

Another continuous miner is shown in U.S. Pat. No. 4,037,875 that incorporates fans for removing the dust-laden air from the vicinity of the cutting heads. The '875 patent discloses the use of nozzles for spraying a liquid into the confined area adjacent the face of the mine but does not specifically disclose any means for removing the dust from the air that is exhausted by the fans that are incorporated in the mining apparatus.

Three Technology News bulletins of the Bureau of Mines, United States Department of the Interior, No. 117, Nov. 1981; No. 322, Jan. 1989; and No. 337, May 1989, all describe high pressure scrubbers for use with continuous underground mining equipment. All of these scrubbers depend on the high pressure water nozzles for producing an air flow through the scrubber and removing the dust. This results in a large consumption of water in relation to the air flow produced and creates a water disposal problem. In addition, all of the systems utilize demisters for removing the water and entrained dust from the air before it is returned to the mine atmosphere. The demisters are screen-type filters that clog after a few hours of use and require frequent cleaning.

From the above description of the prior art patents, it is seen that they all recognize the need to remove the dust-laden air from the vicinity of the cutting head in a continuous mining apparatus but do not provide an efficient means for removing such dust from the air. While the patents do disclose the use of fluid nozzles either for inducing the flow in the air removal means or for suppressing the dust, they do not describe specific means for removing the dust from the air so that the air may be recirculated in the mining operation.

SUMMARY OF THE INVENTION

The present invention provides a method and apparatus for removing the dust particles from the dust-laden air that is produced in a continuous mining operation. In particular, the invention utilizes a wet scrubber that employs twin fluid nozzles for producing a liquid mist having drops ranging in size from a few microns to 50 microns. This size range of liquid drops will remove substantially all the dust particles from the air that is removed from the vicinity of the cutting head. This particular type of wet scrubber is more particularly described and claimed in a copending application by the same inventors; Ser. No. 479,775 filed Feb. 14, 1990, now U.S. Pat. No. 5,039,315 and entitled "Method and Apparatus for Separating Particulates from Gas Streams".

The efficiency of the wet scrubber employing twin fluid atomizing nozzles produces a compact unit that can be mounted directly on the pivotal boom that supports the cutting head of the miner. The mounting of the wet scrubber directly on the pivotal boom positions it in close proximity to the cutting head of the miner. This eliminates considerable duct means and fan means that are required for removing the dust-laden air from the vicinity of the cutting head. In addition, it improves the removal efficiency and eliminates the need for curtains and other means that are utilized for isolating the cutting head from the remainder of the mine atmosphere.

The fluid used in the wet scrubber is preferably water and can be discharged directly to the mine floor or, if desired, added to the coal that is being produced by the continuous miner. The twin fluid atomizers used in the wet scrubber have a high efficiency and require very little water for their operation. Thus, there is little water produced by the wet scrubber and this amount can be discharged directly to the mine without creating a disposal problem.

The water and entrained dust are passed through a parallel plate separator where the water and entrained dust are removed from the air before it is returned to the mine atmosphere. The use of a parallel plate separator eliminates the clog problems that occur when demisters are used.

The discharge from the wet scrubber, being substantially free of any entrained dust particles, can be circulated directly back to the cutting head of the continuous miner. The air may be recirculated using the normal flow of the air curtain that is utilized in continuous miners to remove methane gas that is released during the mining operation.

BRIEF DESCRIPTION OF THE DRAWINGS

The present invention will be more easily understood from the following detailed description when taken in conjunction with the attached drawings in which.

DESCRIPTION OF THE PREFERRED EMBODIMENT

Figure 1:
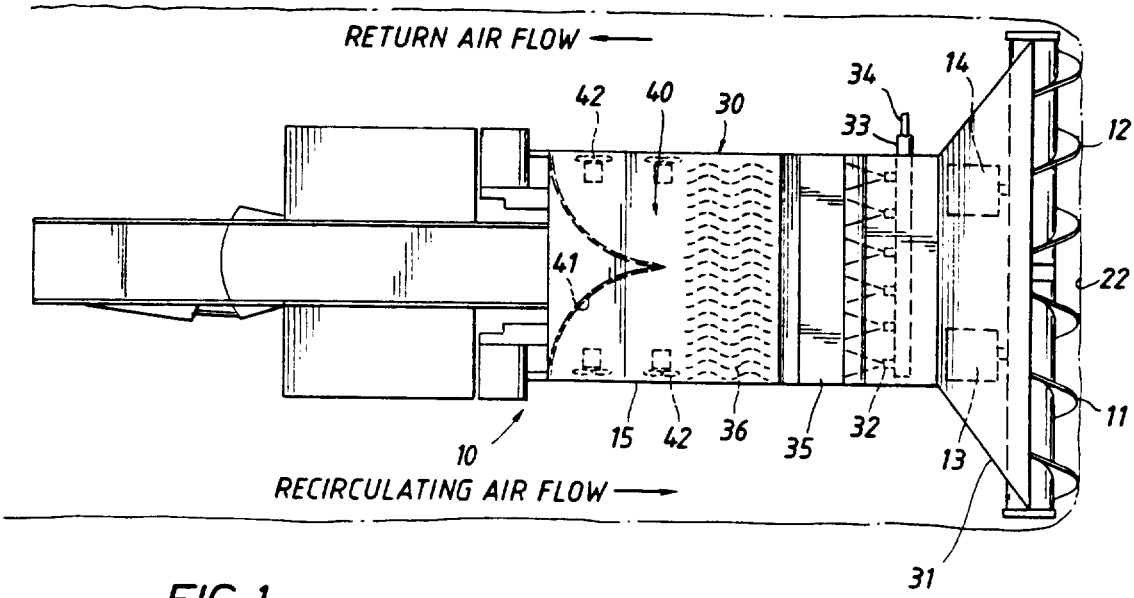
FIG. 1 is a plan view of a continuous miner showing the wet scrubber of this invention.

Referring now to the attached drawings, there is shown a continuous mining apparatus 10. The apparatus is provided with two separate rotary cutting heads 11 and 12 that are powered by suitable electric motors 13 and 14. The cutting heads 11 and 12 are mounted on a pivoted boom 16 that is supported by the track carriage 15. Suitable means such as the hydraulic cylinder 17 is used for raising and lowering the boom so that the cutting heads can traverse the coal face 22 from the floor 20 to the roof of the mine 21. The track carriage 15 is maneuvered by a suitable drive means, such as electric motors.

While the above description refers to a continuous mining apparatus that utilizes cutting heads that rotate about a horizontal axis and are mounted on a boom which is pivoted so that they can be raised and lowered, obviously, other arrangements could be used. Many different types of continuous mining equipment are available and they all produce the same problem of dust-laden air. The present invention can be applied to any of these various types of mining equipment by those skilled in the art.

Figure 2:
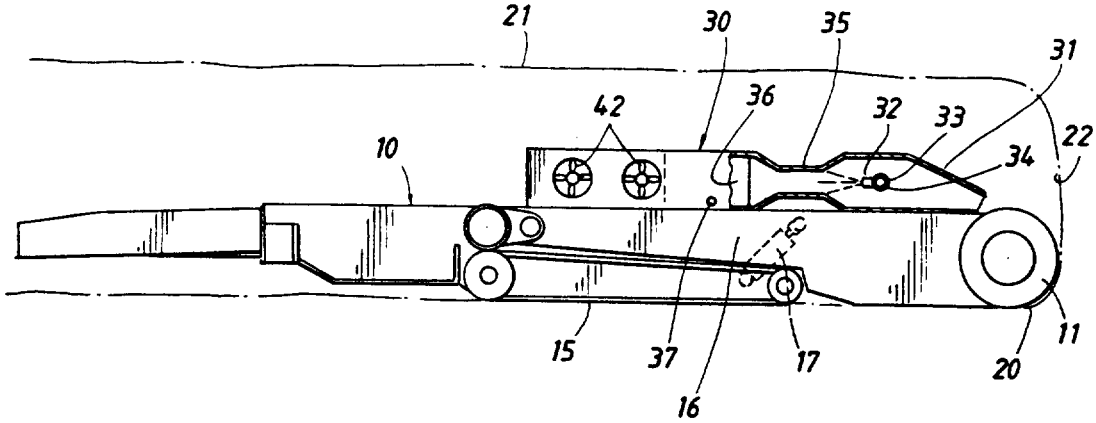
FIG. 2 is a side view of the continuous miner and wet scrubber combination shown in FIG. 1.

The wet scrubber 30 of the present invention is mounted on top of the boom 16 of the mining apparatus. Thus, the wet scrubber will be raised and lowered as the boom is maneuvered so that the cutting heads can cut the complete face of the coal seam. The wet scrubber is provided with duct work which includes a tapered section 31 positioned adjacent the cutting head. As shown in FIGS. 1 and 2, the tapered section 31 flares outwardly in FIG. 1 so that it will remove the dust-laden air from the complete length of the two cutting heads 11 and 12. The top surface of the tapered section 31 slopes downwardly as shown in FIG. 2 so that as the boom is raised, the cutting heads can cut to the roof of the mine. In some cases, it may be desirable to include flexible panels in the tapered inlet section 31 of the wet scrubber in order that they may deform when the cutting head is raised to a position where the section 31 would contact the roof of the mine.

The wet scrubber is provided with six twin fluid atomizers 32 as shown in FIG. 1. The twin fluid atomizers are supplied with two fluids by means of two separate lines 33 and 34. It is preferable that the fluids by water and compressed air although other combinations can be used. As explained in the copending application, the twin fluid atomizers are designed to supply a liquid mist of atomized droplets having a size range of between a few microns and 50 microns. This size range of particles has been found to be most efficient for removing dust particles from dust-laden air produced in coal mining operations.

Downstream of the twin fluid atomizers is a reduced cross section of the duct work 35. The reduced cross section is used so that the twin fluid atomizers can completely cover the cross sectional area of the duct work with a liquid mist and force all the dust-laden air to pass through the mist. Downstream from the reduced cross sectional area is a separator section 36 that is shown as composed of corrugated parallel plate members. This type of separator is highly efficient in removing liquids from the air stream while requiring only a small energy input to produce the air flow across the separator. The water removed from the air stream can be drained through an opening 37 directly to the conveyor associated with the continuous mining since the quantity of water required for the wet scrubber is considerably less than that of scrubbers that rely solely upon water sprays for removing dust particles entrapped in an air flow.

The use of parallel plate members eliminates the clogging problems associated with demisters used in the prior art. In addition, they require less energy to produce a given air flow through the separator.

The separator 36 discharges into an exhaust section 40 of the wet scrubber. The exhaust section 40 is provided with a diverter element 41 that serves to divert the air flow of either side of the wet scrubber. The air flow through the scrubber is induced by means of multiple fan elements 42 as shown in the attached drawings. The fan elements are preferably high efficiency fans that have low noise level to reduce the noise produced by the wet scrubber to permissible limits. The air discharged from the scrubber can be mixed with the air flowing in the air curtain used for removing methane from the mine.

From the above description of a preferred embodiment, it is seen that the present invention has provided a highly efficient wet scrubber which can be mounted directly on the boom of the continuous mining apparatus. By mounting the scrubber directly on the boom the need for duct work for removing the dust-laden to a remote location is eliminated. Further, the air discharged from the scrubber, being substantially free of any dust particles, can be utilized in the air flow that normally is provided in a mine for maintaining safe operations. As explained in the copending application, the overall removal efficiency of the wet scrubber is above 99.5%. Thus, the air can be utilized in normal ventilation activities in the mine while the dust-laden water can be discharged directly to the mined coal. The quantity of water required to operate the scrubber is small, i.e., less than 3 gallons per minute for an air flow of 6000 cubic feet per minute, and can be supplied from tanks mounted on the miner or other sources. The quantity of compressed air required is less than 60 standard cubic feet per minute, and can be supplied from a compressor mounted on the miner.

What is claimed is:

1. A continuous mining apparatus having a pivoted boom with a cutting head mounted on its free end, the improvement comprising:

a wet scrubber mounted on said boom adjacent said cutting head, said wet scrubber including means to induce an air flow to remove dust-laden air from the vicinity of the cutting head, removing the dust from said air and discharging the cleaned air; and a plurality of twin fluid atomizers, said atomizers producing a liquid mist having droplets ranging in size from a few microns to 50 microns, said atomizers being mounted in said wet scrubber near the inlet thereof and positioned to direct said liquid mist over the complete cross section of said wet scrubber.

2. The continuous mining apparatus of claim 1 wherein said wet scrubber includes a corrugated parallel plate separator positioned downstream of the two fluid atomizers for removing the dust-laden water from the air.

3. The continuous mining apparatus of claim 3 wherein said wet scrubber includes duct work, said duct work having an open end located in the vicinity of the cutting head and discharge openings located in the opposite end, said twin fluid atomizers being mounted in said duct work adjacent said open end and discharging toward said discharge openings, said corrugated parallel plate separator being positioned between said twin fluid atomizers and said discharge openings.

4. The continuous mining apparatus of claim 3 wherein the means for inducing an air flow comprises fans mounted adjacent said discharge openings.

5. A method for reducing the concentration of dust particles produced by continuous mining apparatus, comprising:

removing the dust-laden air from the vicinity of the cutting head of said continuous mining apparatus;

treating said dust-laden air with a wet scrubber using twin fluid atomizers to produce a liquid mist having droplets ranging from a few microns to 50 microns, one of said fluids being water and the other fluid being compressed air; and discharging the water and entrained dust particles into the mine while recirculating clean air back to the vicinity of the cutting head.

* * * * *